US009744661B2

(12) United States Patent
Boeck et al.

(10) Patent No.: US 9,744,661 B2
(45) Date of Patent: Aug. 29, 2017

(54) MACHINE TOOL

(71) Applicant: Robert Bosch GmbH, Stuttgart (DE)

(72) Inventors: Cornelius Boeck, Kirchheim (DE); Daniel Barth, Leinfelden-Echterdingen (DE); Joachim Schadow, Stuttgart (DE); Sinisa Andrasic, Schoenaich (DE)

(73) Assignee: Robert Bosch GmbH, Stuttgart (DE)

( * ) Notice: Subject to any disclaimer, the term of this patent is extended or adjusted under 35 U.S.C. 154(b) by 513 days.

(21) Appl. No.: 14/366,367

(22) PCT Filed: Nov. 12, 2012

(86) PCT No.: PCT/EP2012/072354
§ 371 (c)(1),
(2) Date: Jun. 18, 2014

(87) PCT Pub. No.: WO2013/092000
PCT Pub. Date: Jun. 27, 2013

(65) Prior Publication Data

US 2014/0332245 A1 Nov. 13, 2014

(30) Foreign Application Priority Data

Dec. 23, 2011 (DE) ..... 10 2011 089 718

(51) Int. Cl.
*B25F 5/02* (2006.01)
*B24B 23/02* (2006.01)
(Continued)

(52) U.S. Cl.
CPC ..... *B25F 5/02* (2013.01); *B24B 23/028* (2013.01); *H01H 3/122* (2013.01); *H01H 13/08* (2013.01);
(Continued)

(58) Field of Classification Search
CPC ..... B25F 5/02; B25C 1/06; H01H 2003/028; H01H 3/04; H01H 3/122; H01H 3/14;
(Continued)

(56) References Cited

U.S. PATENT DOCUMENTS 2,477,150 A * 7/1949 Yost ..... H02K 7/145 173/170
3,873,796 A * 3/1975 Worobec, Jr. ..... H01H 9/06 200/320
(Continued)

FOREIGN PATENT DOCUMENTS

CN 1476959 A 2/2004
CN 1859999 A 11/2006
(Continued)

OTHER PUBLICATIONS

International Search Report corresponding to PCT Application No. PCT/EP2012/072354, mailed Apr. 18, 2013 (German and English language document) (9 pages).

*Primary Examiner* — Thanh Truong
*Assistant Examiner* — Dariush Seif
(74) *Attorney, Agent, or Firm* — Maginot, Moore & Beck LLP

(57) ABSTRACT

A machine tool includes at least one handle housing having at least one switching unit with at least one ratchet element arranged on the at least one handle housing and at least one bearing unit, which is provided to support the at least one ratchet element at least movably relative to the at least one handle housing. The at least one bearing unit includes at least one lever drive unit, which is provided in order to enable a uniform stroke motion over an entire operating surface of the at least one ratchet element during an actuation of the at least one ratchet element.

10 Claims, 4 Drawing Sheets

(51) Int. Cl.
*H01H 3/12* (2006.01)
*H01H 13/08* (2006.01)

(52) U.S. Cl.
CPC ... *H01H 2221/00* (2013.01); *H01H 2231/048* (2013.01)

(58) Field of Classification Search
CPC .... H01H 13/08; H01H 13/186; H01H 13/183; H01H 3/46; H01H 13/66
USPC ..... 173/170; 451/344, 359; 74/473.3, 74/490.09, 490.15; 200/332.2, 522, 337, 200/343, 321
See application file for complete search history.

(56) References Cited

U.S. PATENT DOCUMENTS 4,016,684 A * 4/1977 Urda ..... F16P 3/00 173/169
4,381,037 A * 4/1983 Cuneo ..... B23B 45/02 173/170
4,673,043 A * 6/1987 Greppmair ..... B25D 17/11 173/162.2
4,844,177 A * 7/1989 Robinson ..... B25B 23/145 173/169
4,879,438 A * 11/1989 Winchester ..... H01H 9/06 200/505
5,681,214 A * 10/1997 Kleider ..... B23D 45/16 451/344
5,894,117 A * 4/1999 Kamishima ..... H01H 3/125 200/344
6,269,890 B1 * 8/2001 Kremer ..... F27D 3/1527 173/193
6,602,122 B1 * 8/2003 Rudolf ..... B24B 23/005 451/344
6,902,011 B2 * 6/2005 Hall ..... B25B 23/1453 173/168
7,186,940 B1 * 3/2007 Wong ..... H01H 1/18 200/522
7,210,542 B2 * 5/2007 Lam ..... H01H 3/20 173/171
7,537,065 B2 * 5/2009 Gallagher ..... B24B 23/02 173/170
7,820,931 B2 * 10/2010 Lee ..... H01H 5/02 200/522
8,109,425 B2 * 2/2012 Liu ..... B25C 1/008 227/130
8,198,560 B2 * 6/2012 Kimata ..... H01H 3/20 200/318.1
8,286,724 B2 * 10/2012 Furusawa ..... B25D 11/10 173/47
8,453,901 B2 * 6/2013 Suda ..... B25C 1/06 227/117
8,550,181 B2 * 10/2013 Kobayashi ..... H01H 9/047 173/217
8,827,004 B2 * 9/2014 Hosokawa ..... B25F 5/02 173/170
9,024,214 B2 * 5/2015 Niu ..... H01H 3/122 200/341
9,177,733 B2 * 11/2015 Krumpelman ..... H01H 3/122
9,182,167 B2 * 11/2015 Park ..... F25D 23/126
9,330,858 B2 * 5/2016 Boeck ..... H01H 3/20
2003/0190877 A1 * 10/2003 Gallagher ..... B24B 23/02 451/344
2007/0035903 A1 * 2/2007 Sullivan ..... B60P 1/4478 361/78
2008/0011592 A1 * 1/2008 Liebert ..... B25F 5/02 200/43.11
2008/0142351 A1 * 6/2008 Gallagher ..... B24B 23/022 200/522
2008/0302647 A1 * 12/2008 Villain ..... H01H 3/122 200/343
2009/0104861 A1 * 4/2009 Van Der Linde ..... B25F 5/02 451/344
2010/0018734 A1 * 1/2010 Frauhammer ..... B25D 16/006 173/171
2010/0236801 A1 * 9/2010 Furusawa ..... B25D 11/10 173/47
2010/0316457 A1 * 12/2010 Wasielewski ..... B23C 1/20 408/238
2011/0132959 A1 * 6/2011 Hlinka ..... B25C 1/06 227/8
2011/0226600 A1 * 9/2011 Lo ..... H01H 3/122 200/5 A
2011/0248061 A1 * 10/2011 Liu ..... B25C 1/008 227/8
2011/0259719 A1 * 10/2011 Park ..... F25D 23/126 200/310
2012/0048585 A1 * 3/2012 Miyazawa ..... B23D 51/00 173/170
2013/0032455 A1 * 2/2013 Alberti ..... H01H 9/06 200/332.2
2014/0338947 A1 * 11/2014 Boeck ..... B24B 23/028 173/170
2014/0370792 A1 * 12/2014 Boeck ..... B24B 23/028 451/359

FOREIGN PATENT DOCUMENTS

CN 101334682 A 12/2008
DE 197 07 215 A1 9/1997
DE 103 45 135 A1 4/2005
EP 0 502 363 A1 2/1992
EP 1 327 497 A2 7/2003
EP 1 724 057 A2 11/2006
EP 1 728 592 A2 12/2006
EP 2 003 666 A1 12/2008
WO 96/27202 A1 9/1996

* cited by examiner

MACHINE TOOL

This application is a 35 U.S.C. §371 National Stage Application of PCT/EP2012/072354, filed on Nov. 12, 2012, which claims the benefit of priority to Serial No. DE 10 2011 089 718.6, filed on Dec. 23, 2011 in Germany, the disclosures of which are incorporated herein by reference in their entirety.

BACKGROUND

Already known from DE 197 07 215 A1 is a power tool, in particular an angle grinder, which comprises a handle housing, a switching unit that has a latch element arranged on the handle housing, and which comprises a bearing unit, which is provided for mounting the latch element so as to be at least movable relative to the handle housing.

SUMMARY

The disclosure is based on a power tool, in particular an angle grinder, comprising at least one handle housing, comprising at least one a switching unit that has at least one latch element arranged on the handle housing, and comprising at least one bearing unit, which is provided for mounting the latch element so as to be at least movable relative to the handle housing.

It is proposed that the bearing unit comprise at least one lever mechanism unit, which is provided to enable an at least substantially even travel movement over an entire operating surface of the latch element, upon an actuation of the latch element, in particular upon a movement of the latch element in the direction of the handle housing. The power tool is preferably realized as a portable power tool, in particular as a portable, hand-held power tool. A "portable power tool" is to be understood here to mean, in particular, a power tool for performing work on workpieces, that can be transported by an operator without the use of a transport machine. The portable power tool has, in particular, a mass of less than 40 kg, preferably less than 10 kg, and particularly preferably less than 7 kg. Particularly preferably, the portable power tool is preferably realized as an angle grinder. It is also conceivable, however, for the portable power tool to be of a different design, considered appropriate by persons skilled in the art, such as, for example, designed as a hammer drill and/or chipping hammer, power drill, saber saw, compass saw, hedge shears, etc.

A "handle housing" is to be understood here to mean, in particular, at least one housing or at least one housing sub-region that, to a large extent, is dissociated from a mounting of a drive unit and/or output unit of the power tool, wherein at least one grip region of the housing or of the housing sub-region, in particular a housing sub-region realized as a stem-type grip region, can be gripped by an operator, by at least one hand, at least to a large extent, for the purpose of handling the power tool. The expression "can be gripped to a large extent" is intended here to define, in particular, a capability whereby a component or a component region can be gripped by a hand of an operator along at least more than 70%, preferably more than 80%, and particularly preferably more than 90% of a total extent of a total outer circumference of the component or of the component region that runs in a plane extending at least substantially perpendicularly in relation to a direction of longitudinal extent of the component or of the component region, wherein the total extent of the total circumference is, in particular, less than 40 cm, preferably less than 30 cm, and particularly preferably less than 25 cm. Preferably, when the component or component region is gripped, a hand inner surface and finger inner surfaces of the hand of the operator are in contact with the total outer circumference at least along a distance greater than 70%, preferably greater than 80%, and particularly preferably greater than 90% of the total extent of the total outer circumference. Preferably, the handle housing is realized so as to be separate from a drive housing of the power tool that is provided to accommodate the drive unit and/or output unit, in order to support drive bearing forces and/or output bearing forces. It is also conceivable, however, for the handle housing and the drive housing to be realized as a single piece.

Preferably, the handle housing has a stem-type grip region. The expression "stem-type grip region" is intended here to define, in particular, a housing sub-region of the handle housing that, as viewed in a longitudinal sectional plane, in which the direction of main extent of the power tool extends, along a direction running at least substantially perpendicularly in relation to the direction of main extent, has a maximum extent, in particular, of less than 10 cm, preferably of less than 8 cm, and particularly preferably of less than 6 cm, wherein at least one operating surface of the handle housing is arranged in the housing sub-region of the handle housing. Preferably, the maximum extent, as viewed in the longitudinal sectional plane, is delimited by at least two parallel straight lines, or by at least two straight lines, inclined relative to each other by an angle of less than 10°, preferably of less than 8°, and particularly preferably of less than 6°, that are constituted by an outer contour of the housing sub-region of the handle housing. The stem-type grip region is inclined relative to a direction of main extent of the power tool, in particular, at least by an angle of less than 60°, preferably of less than 40°, and particularly preferably of less than 30°. Preferably, the stem-type grip region, as viewed along a rotation axis of a drive element, in particular of an armature shaft, a drive unit of the power tool, and in particular along the direction of main extent of the power tool, is arranged behind the drive unit.

Moreover, it is conceivable for the handle housing, in addition to having the stem-type grip region, to have a bow-shaped sub-region, which is integrally formed on to the stem-type grip region. The bow-shaped sub-region may preferably be of an L-shaped design, which extends in an L shape in the direction of the connecting region, starting from an end of the stem-type grip region that faces away from the connecting region of the handle housing. Particularly preferably, the handle housing comprises at least two handle housing shell elements, which can be joined to each other in a joint plane. The handle housing thus preferably has a shell-type structure. It is also conceivable, however, for the handle housing to have a pot-type structure.

The term "switching unit" is intended there to define, in particular, a unit having at least one component, in particular the latch element, which can be actuated directly by an operator, and which is provided to influence and/or alter a process and/or a state of a unit coupled to the switching unit, through an actuation and/or through an input of parameters. The latch element is preferably provided for actuating at least one switching element of the switching unit. A "latch element" is to be understood here to mean, in particular, an operating element that, along a direction of longitudinal extent of the operating element, has a longitudinal extent that is greater than a transverse extent of the operating element that runs at least substantially perpendicularly in relation to the direction of longitudinal extent and runs at least substantially transversely in relation to a main direction of movement of the operating element.

"Substantially transversely" is to be understood here to mean, in particular, an alignment of a direction and/or of an axis relative to a reference direction and/or to a reference axis, wherein the alignment of the direction and/or of the axis are at least different from an at least substantially parallel alignment in relation to the reference direction and/or to the reference axis and, in particular, are askew or perpendicular in relation to the reference direction and/or to the reference axis. A "latch element" is to be understood here to mean, in particular, an operating element that, along a direction of longitudinal extent of the operating element, has a longitudinal extent that is greater than a transverse extent of the operating element that runs at least substantially perpendicularly in relation to the direction of longitudinal extent and runs at least substantially transversely in relation to a direction of movement of the operating element. Preferably, a maximum longitudinal extent of the latch element is at least 2 times greater, preferably at least 4 times greater, and particularly preferably at least 6 times greater than a maximum transverse extent of the latch element. The latch element has, in particular, a maximum longitudinal extent that is greater than 3 cm, preferably greater than 6 cm, and particularly preferably greater than 8 cm. In addition, the latch element preferably comprises an operating surface on which an operator can place at least three fingers in order to actuate the latch element, and which has at least one longitudinal extent that is greater than 5 cm, running along the direction of longitudinal extent of the latch element. The latch element preferably comprises an operating surface, in particular an operating surface constituted by a grip surface region of the latch element, on which an operator can place at least three fingers in order to actuate the latch element, and which has at least one longitudinal extent that is greater than 5 cm, running along the direction of longitudinal extent of the latch element.

The expression "substantially perpendicularly" is intended here to define, in particular, an alignment of a direction relative to a reference direction, wherein the direction and the reference direction, in particular as viewed in one plane, enclose an angle of 90° and the angle has a maximum deviation of, in particular, less than 8°, advantageously less than 5°, and particularly advantageously less than 2°. Preferably, the switching unit is provided to actuate the switching element by means of an actuation of the latch element, in order to open or close an electric circuit for supplying energy, at least to a drive unit of the power tool. The switching unit is thus preferably provided to enable the power tool to be put into operation or deactivated. "Provided" is to be understood to mean, in particular, specially designed and/or specially equipped. The switching element is preferably constituted by a mechanical, electrical and/or electronic switching element.

The term "bearing unit" is intended here to define, in particular, a unit provided to limit a number of degrees of freedom of movement of at least one component, wherein the unit has at least one bearing element that enables the component to be moved in a guided manner along and/or about at least one movement axis of the component. The bearing unit in this case may be realized as a translational bearing unit and/or as a rotational bearing unit. Particularly preferably, the bearing unit is realized as a rotational bearing unit. A "lever mechanism unit" is to be understood here to mean, in particular, a unit provided to convert at least one translational movement of an element, in particular of the latch element, as a result of an actuation by an operator, into a rotational movement of the element about at least one axis, wherein the unit preferably has at least one rod-shaped bearing element that is movably arranged on the element to be moved.

Preferably, the lever mechanism unit is realized as a coupler mechanism. The expression "at least substantially even travel movement over an entire operating surface" is intended here to define, in particular, a movement of the operating surface of the latch element, in at least one direction, in which at least two ends of the operating surface that face away from each other have a maximum difference in movement distance, in particular a difference in movement distance caused by production tolerances and/or by a bearing play, that, in particular, is less than 10 mm, preferably less than 5 mm, and particularly preferably less than 2 mm. Advantageously, by means of the design of the power tool according to the disclosure, it is possible to achieve an exact guidance of the latch element during a movement as a result of an actuation of the latch element. Advantageously, a high degree of operating comfort can thus be achieved. Moreover, advantageously, it is possible to achieve an even travel movement of the latch element that, to a very large extent, is non-dependent on a position of an actuating point that is actuated, on the operating surface of the latch element, by an operator.

Furthermore, it is proposed that at least one lever bearing element of the lever mechanism unit be movably connected to the latch element, at an end of the latch element that faces toward a connecting region of the handle housing. The expression "connecting region" is to be understood here to mean, in particular, a region of the handle housing via which the handle housing is connected to the drive housing in a form closed, force closed and/or materially bonded manner, or by means of which the handle housing bears directly against the drive housing. An "end of the latch element that faces toward the connecting region" is to be understood here to mean, in particular, an arrangement of points of the latch element, in respect of a central plane of the latch element, that runs at least substantially perpendicularly in relation to the direction of longitudinal extent of the latch element, and that is arranged at least substantially equally from two ends of the latch element that are spaced apart from each other along the direction of longitudinal extent of the latch element, wherein all points of the latch element, that are arranged, starting from the central plane, in the direction of the connecting region, as viewed along the direction of longitudinal extent of the latch element, are considered to face toward the connecting region. It is conceivable in this case for the end of the latch element that faces toward the connecting region to be dissociated from a travel movement in a bearing point at which at least one bearing element of the bearing unit is arranged on the latch element. Preferably, the end of the latch element that faces toward the connecting region executes a travel movement along a distance that, in particular, is greater than 0.5 mm, preferably greater than 1 mm, and particularly preferably greater than 2 mm, in particular in the bearing point, as a result of an actuation. By means of the design according to the disclosure, it is advantageously possible to achieve a rotation point of the latch element that is arranged outside of the latch element, such that an advantageous lever ratio can be achieved.

It is additionally proposed that the lever mechanism unit have at least one further lever bearing element, which is movably connected to the latch element, at the end of the latch element that faces toward the connecting region of the handle housing, and arranged in a movable manner on a bearing element of the bearing unit that is arranged on a side of an actuating region of a switching element of the switching unit that faces toward the connecting region of the handle housing. Advantageously, by means of the arrangement according to the disclosure, and a combined action of the lever bearing element and of the further lever bearing element, it is possible to realize a precise guidance of the latch element upon a movement of the latch element.

Particularly preferably, the lever mechanism unit is realized as a parallelogram lever mechanism unit. A "parallelogram lever mechanism unit" is to be understood here to mean, in particular, a unit that keeps at least substantially constant an alignment of the operating surface relative to the handle housing, upon a movement of the latch element, in particular upon a movement about the pivot axis of the latch element, relative to the handle housing. Preferably, bearing elements of the parallelogram lever mechanism unit constitute a parallelogram-type arrangement, in the case of a notional, rectilinear connection of the bearing elements to each other, in particular as viewed in a plane. Thus, advantageously, a uniform travel movement can be achieved, over the entire operating surface of the latch element, in the direction of the handle housing, as a result of an actuation of the latch element. Advantageously, it is thus possible to achieve comfortable operation of the latch element.

It is additionally proposed that the lever mechanism unit have at least one lever bearing element that actuates an actuating region of a switching element of the switching unit in dependence on a movement of the latch element. Preferably, the lever bearing element is realized as a lever having a respective bearing recess at least at two ends of the lever bearing element that face away from each other. The lever bearing element is preferably connected, by one end, to a bearing element of the bearing unit that is arranged in the handle housing. The lever bearing element preferably actuates the actuating region, realized as a switching tappet, of the switching element, in dependence on a movement of the latch element, for the purpose of putting the power tool into operation. Advantageously, a saving in components can be realized for the actuation of the switching element, in that the lever bearing element can assume a bearing function and an actuating function.

Furthermore, it is proposed that the latch element have a maximum longitudinal extent that corresponds to at least 60% of a maximum longitudinal extent of a stem-type grip region of the handle housing. In particular, a maximum longitudinal extent of the latch element corresponds, in particular, to more than 75%, preferably to more than 80%, and particularly preferably to more than 90% of the maximum longitudinal extent of the stem-type grip region of the handle housing. When the latch element and the handle housing are in a mounted state, the maximum longitudinal extent of the latch element and the maximum longitudinal extent of the stem-type grip region of the handle housing extend along a direction that runs in the joint plane of the handle housing, in which the handle housing shell elements bear against each other, or are joined to each other, when in a mounted state, and that runs at least substantially transversely in relation to the main direction of movement of the latch element. Advantageously, a large usable operating surface of the latch element can be achieved. It is thus advantageously possible to create a latch element that is comfortable to operate.

Advantageously, a ratio of the maximum longitudinal extent of the latch element to the maximum longitudinal extent of the stem-type grip region of the handle housing is at least greater than 1 to 1.4. Preferably, the ratio of the maximum longitudinal extent of the latch element to the maximum longitudinal extent of the stem-type grip region is at least greater than 1 to 1.3 and, particularly preferably, the ratio is greater than 1 to 1. Advantageously, comfortable actuation of the latch element can be achieved, at least substantially over the maximum longitudinal extent of the stem-type grip region. A high degree of operating comfort can thus be achieved.

It is additionally proposed that the latch element have a maximum transverse extent that corresponds to at least 60% of a maximum transverse extent of the stem-type grip region of the handle housing. The expression "maximum transverse extent" is intended there to define, in particular, a maximum extent of a component or of a housing, in particular of a multipart housing, when in a mounted state, along a direction that runs at least substantially perpendicularly in relation to the direction of main extent of the power tool and at least substantially transversely at least in relation to a main direction of movement of the latch element. Preferably, a maximum transverse extent of the latch element corresponds, in particular, to more than 65%, preferably to more than 70%, and particularly preferably to more than 75% of the maximum transverse extent of the stem-type grip region. Advantageously, by means of the design of the power tool according to the disclosure, it is possible to achieve an ergonomically appropriate design of the latch element. Advantageously, a high degree of operating comfort can thus be achieved.

Particularly preferably, a ratio of the maximum transverse extent of the latch element to the maximum transverse extent of the stem-type grip region of the handle housing is at least greater than 1 to 2.5. Preferably, the ratio of the maximum transverse extent of the latch element to the maximum transverse extent of the stem-type grip region of the handle housing is at least greater than 1 to 2 and, particularly preferably, the ratio is greater than 1 to 1.4. Advantageously, owing to an advantageous geometry of the latch element that can be achieved because of the ratio of the maximum transverse extent of the latch element to the maximum transverse extent of the stem-type grip region of the handle housing, only a small force is exerted upon inner surfaces of fingers and/or upon an inner surface of a hand of an operator when actuating the latch element.

Furthermore, it is proposed that the switching unit have at least one switching element, which comprises an actuating region that is subjected to load by a spring element of the switching unit and that, in at least one operating state, applies a force to the latch element, in the direction of an initial position of the latch element, as a result of a spring force of the spring element. A "spring element" is to be understood to mean, in particular, a macroscopic element having at least one extent that, in a normal operating state, can be varied elastically by at least 10%, in particular by at least 20%, preferably by at least 30%, and particularly advantageously by at least 50% and that, in particular, generates a counter-force, which is dependent on a variation of the extent and preferably proportional to the variation and which counteracts the variation. An "extent" of an element is to be understood to mean, in particular, a maximum distance of two points of a perpendicular projection of the element on to a plane. A "macroscopic element" is to be understood to mean, in particular, an element having an extent of at least 1 mm, in particular of at least 5 mm, and preferably of at least 10 mm. Advantageously, by means of the spring element, a dead man's circuit of the switching unit can be achieved. Thus, advantageously, it is possible to achieve a high degree of safety against the power tool being unintentionally put into operation.

The disclosure is additionally based on a power tool switching device for a power tool according to the disclosure, wherein the power tool switching device comprises at least the switching unit and at least the bearing unit. Thus, advantageously, already existing power tools can easily be retrofitted with the switching unit and the bearing unit according to the disclosure.

The power tool according to the disclosure and/or the power tool switching device according to the disclosure are/is not intended in this case to be limited to the application and embodiment described above. In particular, the power tool according to the disclosure and/or the power tool switching device according to the disclosure may have individual elements, components and units that differ in number from a number stated herein, in order to fulfill a principle of function described herein.

BRIEF DESCRIPTION OF THE DRAWINGS

Further advantages are given by the following description of the drawing. The drawing shows an exemplary embodiment of the disclosure. The drawing, the description and the claims contain numerous features in combination. Persons skilled in the art will also expediently consider the features individually and combine them to create appropriate further combinations.

In the drawing.

DETAILED DESCRIPTION

Figure 1:
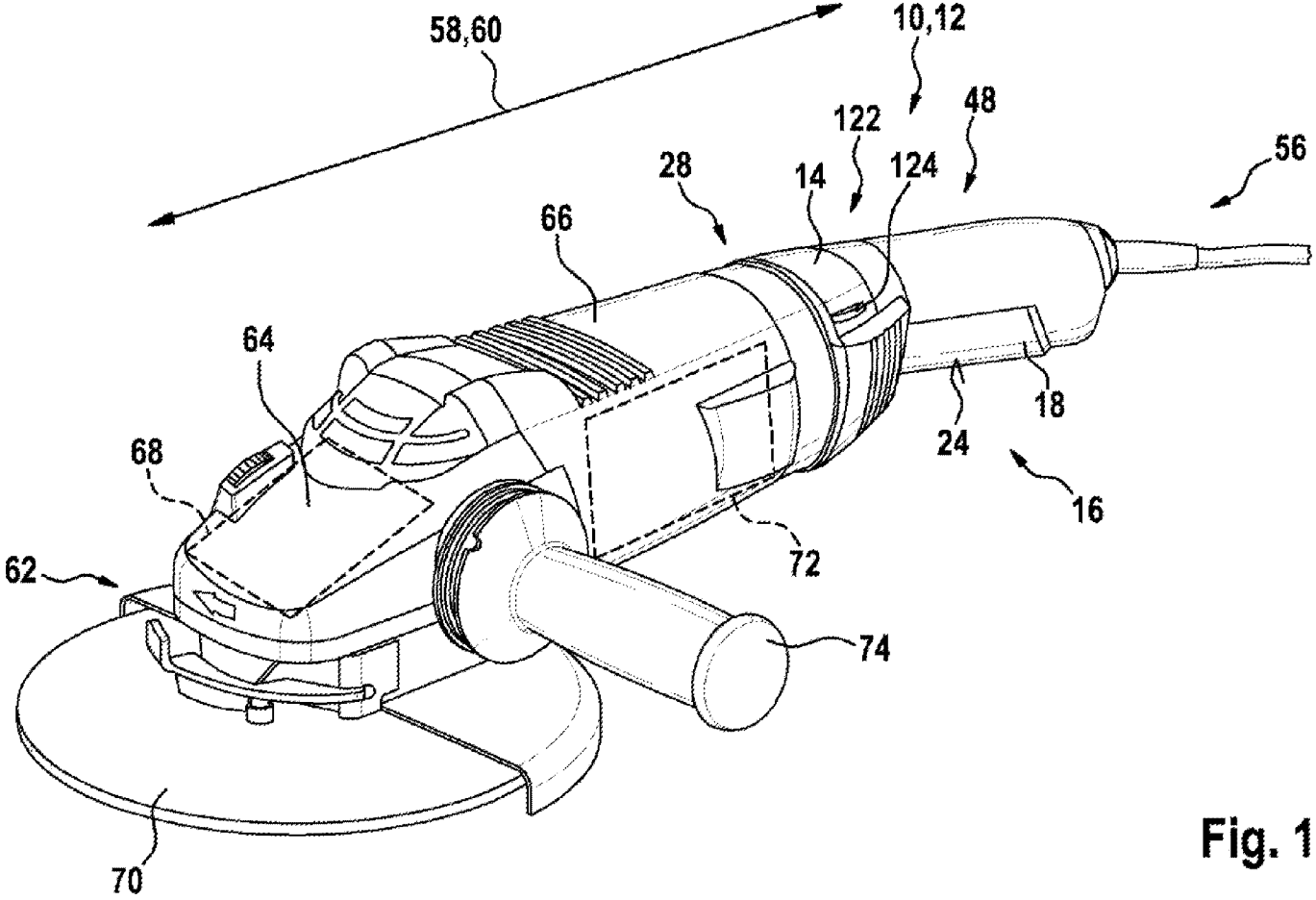
FIG. 1 shows a power tool according to the disclosure, in a schematic representation.

FIG. 1 shows a power tool 10, which is constituted by a portable power tool 10 realized as an angle grinder 12. The portable power tool 10 comprises at least one handle housing 14, at least one switching unit 16, which has at least one latch element 18, arranged on the handle housing 14, for actuating a switching element 40 of the switching unit 16, and at least one bearing unit 20, which is provided to mount the latch element 18 so as to be at least movable relative to the handle housing 14. The portable power tool 10 in this case has at least one power tool switching device, which comprises at least the switching unit 16 and at least the bearing unit 20 for mounting the latch element 18 of the switching unit 16 in a movable manner. The bearing unit 20 comprises at least one lever mechanism unit 22, which is provided to enable an even travel movement over an entire operating surface 24 of the latch element 18, upon an actuation of the latch element 18. The handle housing 14 in this case comprises a stem-type grip region 48, on which the latch element 18 is arranged. The stem-type grip region 48 of the handle housing 14 constitutes a main handle of the portable power tool 10. In this case, the main handle constituted by the stem-type grip region 48 extends, at least substantially, starting from a connecting region 28 of the handle housing 14, in a direction away from the connecting region 28, as far as a side 56 of the handle housing 14 on which there is arranged a cable of the portable power tool 10, realized as an angle grinder 12, for supplying energy. The stem-type grip region 48 of the handle housing 14 is offset relative to a direction of main extent 58 of the handle housing 14*a*, or relative to a direction of main extent 60 of the portable power tool 10, by an angle of less than 30°.

The portable power tool 10, realized as an angle grinder 12, additionally comprises a protective cover unit 62, a drive housing 64 and an output housing 66. Extending out from the output housing 66 there is an output shaft of an output unit 68 of the portable power tool 10, which is realized as a spindle (not represented in greater detail here), to which a working tool 70 can be fixed, for performing work on a workpiece (not represented in greater detail here). The working tool 70 is realized as an abrasive disk. It is also conceivable, however, for the working tool 70 to be realized as a parting disk or polishing disk. The portable power tool 10 comprises the drive housing 64, for accommodating a drive unit 72 of the portable power tool 10, and the output housing 66, for accommodating the output unit 68. The drive unit 72 is provided to drive the working tool 70 in rotation, via the output unit 68. For the purpose of performing work on a workpiece, the working tool 70 in this case may be connected to the spindle in a rotationally fixed manner by means of a fastening element (not represented in greater detail here). The working tool 70 can thus be driven in rotation when the portable power tool 10 is in operation. The output unit 68 is connected to the drive unit 72 via a drive element (not represented in greater detail here) of the drive unit 72 that is realized as a pinion gear and that can be driven in rotation, in a manner already known to persons skilled in the art. In addition, an ancillary handle 74 is arranged on the output housing 66. When mounted on the output housing 66, the ancillary handle 74 extends transversely in relation to the direction of main extent 60 of the portable power tool 10.

Figure 2:
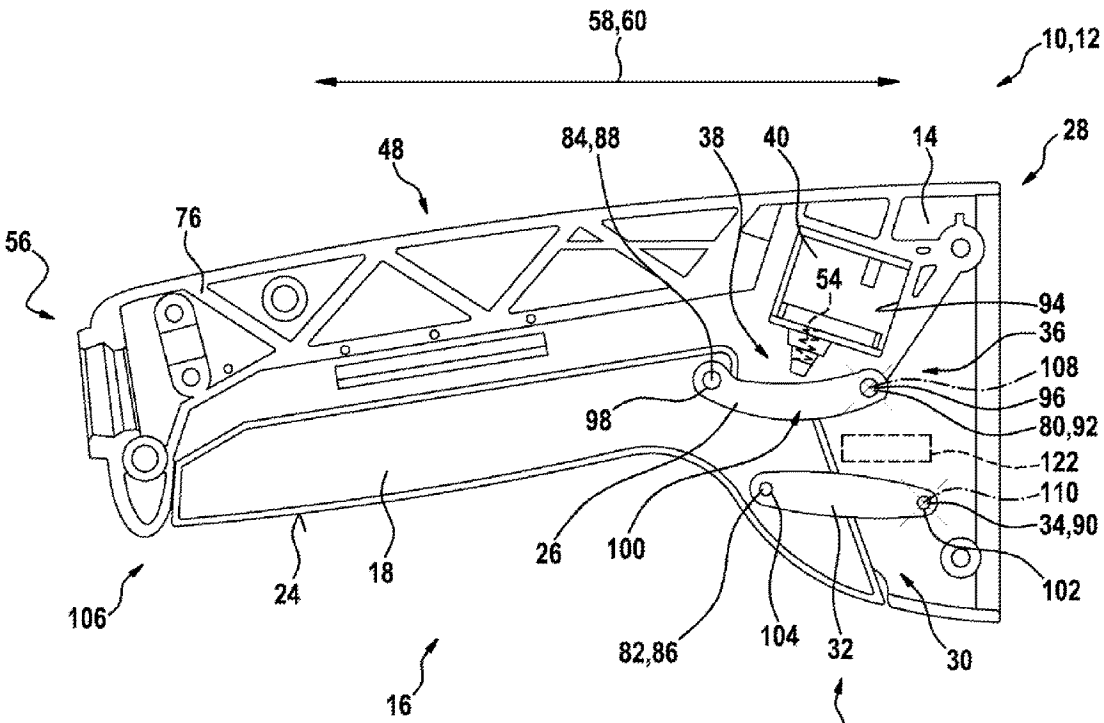
FIG. 2 shows a detail view of a switching unit of the power tool according to the disclosure and of a bearing unit of the power tool according to the disclosure, when mounted in a handle housing of the power tool according to the disclosure, with the switching unit in an unactuated state, in a schematic representation.

FIG. 2 shows a detail view of the switching unit 16 and of the bearing unit 20 when mounted in the handle housing 14, with the switching unit 16 in an unactuated state, wherein one of at least two handle housing shell elements 76, 78 of the handle housing 14*a* has been removed. The lever mechanism unit 22 has at least one lever bearing element 26, which is arranged at an end of the latch element 18 that faces toward the connecting region 28 of the handle housing 14. In this case, the lever bearing element 26 is movably connected to the latch element 18, and is arranged in a movable manner on the bearing element 80 of the bearing unit 20, which is arranged on a side 36 of an actuating region 38 of the switching element 40 of the switching unit 16 that faces toward the connecting region 28 of the handle housing 14. In addition, the lever mechanism unit 22 has at least one further lever bearing element 32, which is movably connected to the latch element 18, at the end 30 of the latch element 18 that faces toward the connecting region 28 of the handle housing 14, and which is arranged in a movable manner on a further bearing element 34 of the bearing unit 20 that is arranged on a side 36 of the actuating region 38 of the switching element 40 of the switching unit 16 that faces toward the connecting region 28 of the handle housing 14. The bearing unit 20 thus has at least two bearing elements 34, 80, which is arranged on a side 36 of the actuating region 38 of the switching element 40 of the switching unit 16 that faces toward the connecting region 28 of the handle housing 14. In this case, the two bearing elements 34, 80 arranged on the side 36 of the actuating region 38 of the switching element 40 that faces toward the connecting region 28 of the handle housing 14, starting from the latch element 18, as viewed along the direction of main extent 58 of the handle housing 14 in the direction of the connecting region 28, are arranged after the latch element 18, in the handle housing 14, in at least one operating state of the latch element 18. The two bearing elements 34, 80 arranged on a side 36 of the actuating region 38 of the switching element 40 of the switching unit 16 that faces toward the connecting region 28 of the handle housing 14 are thus realized as handle housing bearing elements 90, 92. Furthermore, the bearing unit 20 has at least two further bearing element 82, 84, which are arranged at the end 30 of the latch element 18 that faces toward the connecting region 28 of the handle housing 14. In this case, one of the two further bearing elements 82, 84 is assigned to the lever bearing element 26, and one to the further lever bearing element 32. The two further bearing elements 82, 84 arranged at the end 30 of the latch element 18 that faces toward the connecting region 28 are thus realized as latch bearing elements 86, 88.

The further bearing elements 82, 84, realized as latch bearing elements 86, 88, and the bearing elements 34, 80, realized as handle housing bearing elements 90, 92, are each realized as pin-type bearing elements. In this case, the further bearing elements 82, 84 that are realized as latch bearing elements 86, 88 are realized so as to be integral with the latch element 18. In addition, the bearing elements 34, 80 that are realized as handle housing bearing elements 90, 92 are realized so as to be integral with the handle housing 14. It is also conceivable, however, for the further bearing elements 82, 84, realized as latch bearing elements 86, 88, and the bearing elements 34, 80, realized as handle housing bearing elements 90, 92, to be realized separately from the latch element 18, or separately from the handle housing 14, respectively, and for each to be fixedly connected to the latch element 18, or to the handle housing 14, respectively, by means of a type of connection considered appropriate by persons skilled in the art, such as, for example, a form closure and/or force closure type of connection.

Figure 3:
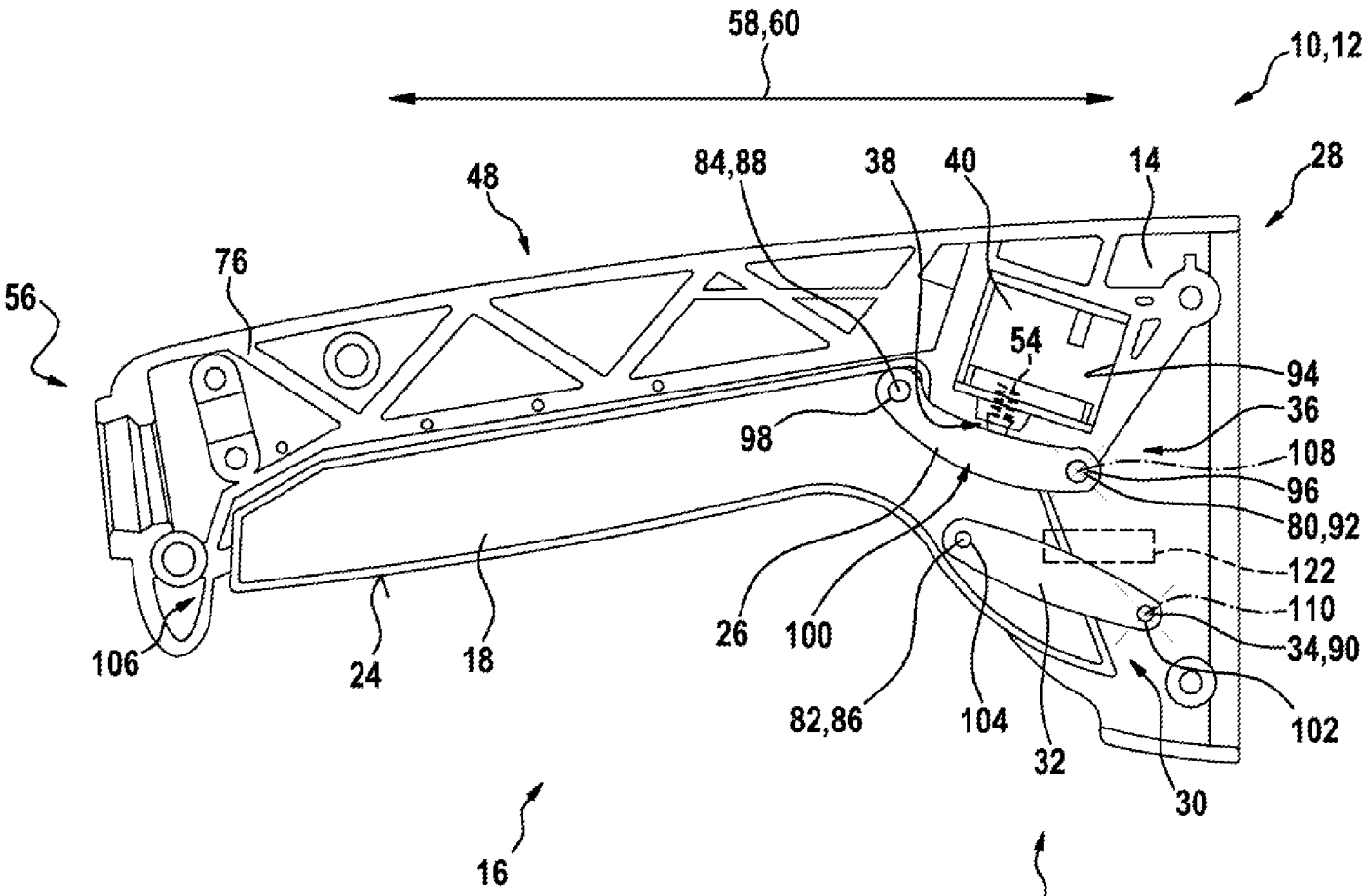
FIG. 3 shows a detail view of the switching unit and of the bearing unit from FIG. 2, when mounted in the handle housing, with the switching unit in an actuated state, in a schematic representation.

The lever mechanism unit 22 is realized as a parallelogram lever mechanism unit 42. It is also conceivable, however, for the lever mechanism unit 22 to be of a different design, considered appropriate by persons skilled in the art such as, for example, a design as a three-hinge coupler mechanism, as a five-hinge coupler mechanism, etc. The lever mechanism unit has at least the lever bearing element 26, which actuates the actuating region 38 of the switching element 40 of the switching unit 16 in dependence on a movement of the latch element 18 (FIG. 3). The switching element 40 in this case is fixedly arranged in a receiving recess 94 of at least one of the handle housing shell elements 76, 78. The receiving recess 94, starting from the latch element 18, as viewed along the direction of main extent 58 of the handle housing in the direction of the connecting region 28, is arranged, at least partially, after the latch element 18, in the handle housing 14. For the purpose of being movably connected to the latch element 18, the lever bearing element 26, which is realized as a lever, has at least two bearing recesses 96, 98, arranged at ends of the lever bearing element 26 that face away from each other. One of the two bearing recesses 96, 98 is connected to one of the two latch bearing elements 86, 88. In addition, one of the two bearing recesses 96, 98 is connected to one of the two handle housing bearing elements 90, 92. Moreover, the lever bearing element 26 is of a curved design in a sub-region 100 between the bearing recesses 96, 98. It is also conceivable, however, for the lever bearing element 26, in the sub-region 100, to be of a different design, considered appropriate by persons skilled in the art, such as, for example, a ridge-type projection, etc. The sub-region 100 is provided to actuate the actuating region 38, realized as a switching tappet, of the switching element 40 of the switching unit 16 in dependence on a movement of the latch element 18.

In addition, the further lever bearing element 32, which is realized as a lever, has at least two bearing recesses 102, 104, arranged at ends of the further lever bearing element 32 that face away from each other. One of the two bearing recesses 102, 104 is connected to one of the two latch bearing elements 86, 88. In addition, one of the two bearing recesses 102, 104 is connected to one of the two handle housing bearing elements 90, 92. The lever bearing element 26 and the further lever bearing element 32 are aligned at least substantially parallelwise in relation to each other, in respect of a rectilinear, notional connecting line of the bearing recesses 96, 98 of the lever bearing element 26 and in respect of a rectilinear, notional connecting line of the bearing recesses 102, 104 of the further lever bearing element 32. Owing to the at least substantially parallel arrangement of the lever bearing element 26 and further lever bearing element 32, a parallel guidance of the latch element 18 is realized, as a result of an actuation of the latch element 18. In this case, a further end 106 of the latch element 18 that can be gripped and that faces away from the connecting region 28 is dissociated from an arrangement of bearing points of the bearing unit 20.

By means of the lever mechanism unit 22 realized as a parallelogram lever mechanism unit 42, a lever ratio that is greater than 1 to 2.7 is achieved between the actuating region 38 of the switching element 40 and the latch element 18. The lever ratio corresponds to a length of a distance, measured from the longitudinal axis of the handle housing bearing element 90, which is connected to one of the bearing recesses 96, 98 of the lever bearing element 26, as far as a central axis of the actuating region 38 of the switching element 40 that is realized as a switching tappet, in relation to a length of a distance, measured from the longitudinal axis of the handle housing bearing element 90, which is connected to one of the bearing recesses 96, 98 of the lever bearing element 26, as far as a longitudinal axis of the latch bearing element 86, which is connected to one of the bearing recesses 96, 98 of the lever bearing element 26.

Furthermore, the switching unit 16 has at least the switching element 40, which comprises the actuating region 38 that is subjected to load by a spring element 54 of the switching unit 16 and that, in at least one operating state, applies a force to the latch element 18, in the direction of an initial position of the latch element 18, as a result of a spring force of the spring element 54. It is also conceivable, however, for the switching unit 16, in addition or as an alternative to having the spring element 54 of the switching element 40, to have a further spring element that is supported on the latch element 18 and on the handle housing 14, and that is provided to apply a spring force to the latch element 18 in the direction of an initial position of the latch element 18. The actuating region 38 subjected to load by a spring element 54 of the switching unit 16 is provided to constitute a dead man's circuit function of the switching unit 16. The spring element 54 is provided to enable the latch element 18 to move into an initial position of the latch element 18, as a result of an action of a spring force upon the latch element 18, via the actuating region 38, after removal of an action of an actuating force of an operator upon the latch element 18, in a direction away from the handle housing 14. The spring element 54 thus exerts a spring force upon the latch element 18 via the actuating region 38, and via the lever bearing element 26, which actuates the actuating region 38, realized as a switching tappet, of the switching element 40 as a result of a movement of the latch element 18 in the direction of the handle housing 14. As a result of this, the latch element 18, after removal of an action of an actuating force of an operator, is moved in the direction away from the handle housing 14. The latch element 18 is mounted so as to be pivotable about pivot axes 108, 110, which go through the handle housing bearing elements 90, 92. The pivot axes 108, 110 in this case constitute longitudinal axes of the handle housing bearing elements 90, 92, about which the handle housing bearing elements 90, 92 are rotationally symmetrical. An alignment of the operating surface 24 of the latch element 18 relative to the handle housing 14 is maintained, at least substantially, by means of the bearing unit 20, upon a movement of the latch element 18 relative to the handle housing 14.

Figure 4:
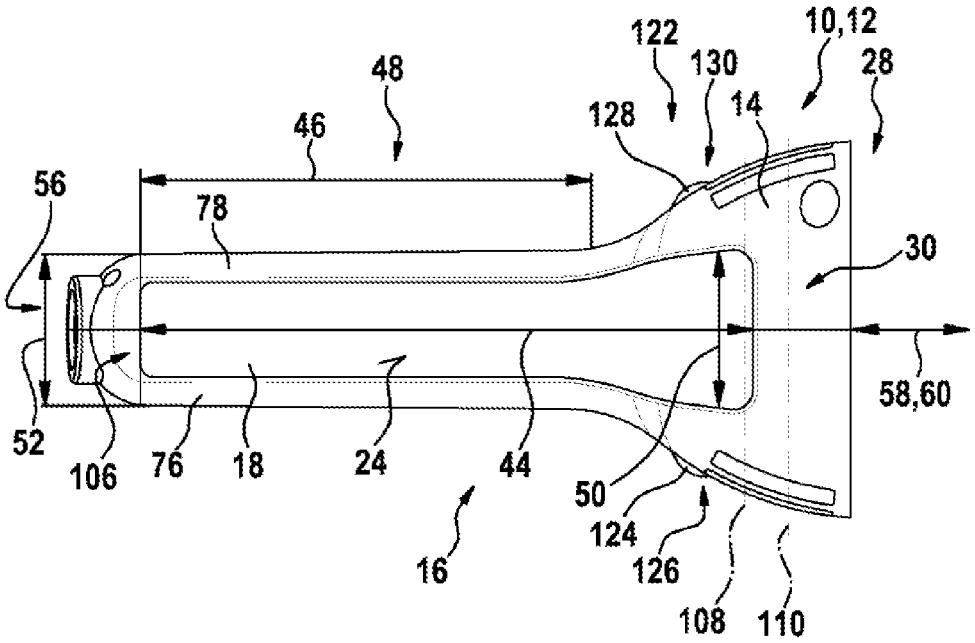
FIG. 4 shows a detail view of a latch element of the switching unit arranged on the handle housing, in a schematic representation.

FIG. 4 shows a detail view of the latch element 18 of the switching unit 16 arranged on the handle housing 14. The latch element 18 is mounted on the handle housing 14 so as to be pivotable about the pivot axes 108, 110 of the latch element 18. The pivot axes 108, 110 of the latch element 18 run at least substantially perpendicularly in relation to the direction of main extent 58 of the handle housing 14, or at least substantially perpendicularly in relation to the direction of main extent 60 of the portable power tool 10. In this case, the pivot axes 108, 110 run at least substantially perpendicularly in relation to a joint plane of the handle housing 14. When in a mounted state, the two handle housing shell elements 76, 78 of the handle housing 14 are joined together in the joint plane of the handle housing 14. The latch element 18 is mounted, at the end 30 that faces toward the connecting region 28 of the handle housing 14*a*, so as to be pivotable about the pivot axis 108, 110.

Furthermore, the latch element 18 has a maximum transverse extent 50 that corresponds to at least 60% of a maximum transverse extent 52 of the stem-type grip region 48 of the handle housing 14. In this case, a ratio of the maximum transverse extent 50 of the latch element 18 to the maximum transverse extent 52 of the stem-type grip region 48 of the handle housing 14 is at least greater than 1 to 2.5. The maximum transverse extent 50 of the latch element 18 runs along a direction that runs at least substantially perpendicularly in relation to the direction of main extent 58 of the handle housing 14, or at least substantially perpendicularly in relation to the direction of main extent 60 of the portable power tool 10, and at least substantially transversely at least in relation to a main direction of movement of the latch element 18. The maximum transverse extent 50 of the latch element 18 thus runs at least substantially parallelwise in relation to the pivot axes 108, 110 of the latch element 18. The maximum transverse extent 52 of the stem-type grip region 48 of the handle housing 14 likewise runs along the direction that runs at least substantially perpendicularly in relation to the direction of main extent 58 of the handle housing 14, or at least substantially perpendicularly in relation to the direction of main extent 60 of the portable power tool 10, and at least substantially transversely at least in relation to a main direction of movement of the latch element 18.

In addition, the latch element 18 has a maximum longitudinal extent 44 that corresponds to at least 60% of a maximum longitudinal extent 46 of a stem-type grip region 48 of the handle housing 14. A ratio of the maximum longitudinal extent 44 of the latch element 18 to the maximum longitudinal extent 46 of the stem-type grip region 48 of the handle housing 14 is at least greater than 1 to 1.4. When the latch element 18 has been mounted on the handle housing 14, the maximum longitudinal extent 44 of the latch element 18 extends along a direction that runs in the joint plane of the handle housing 14, and that runs at least substantially transversely in relation to a main direction of movement of the latch element 18. The maximum longitudinal extent 44 of the latch element 18 thus extends along a direction that runs at least substantially perpendicularly in relation to the pivot axes 108, 110 of the latch element 18. The maximum longitudinal extent 46 of the stem-type grip region 48 of the handle housing 14 likewise extends along the direction that runs at least substantially perpendicularly in relation to the pivot axes 108, 110 of the latch element 18.

Figure 5:
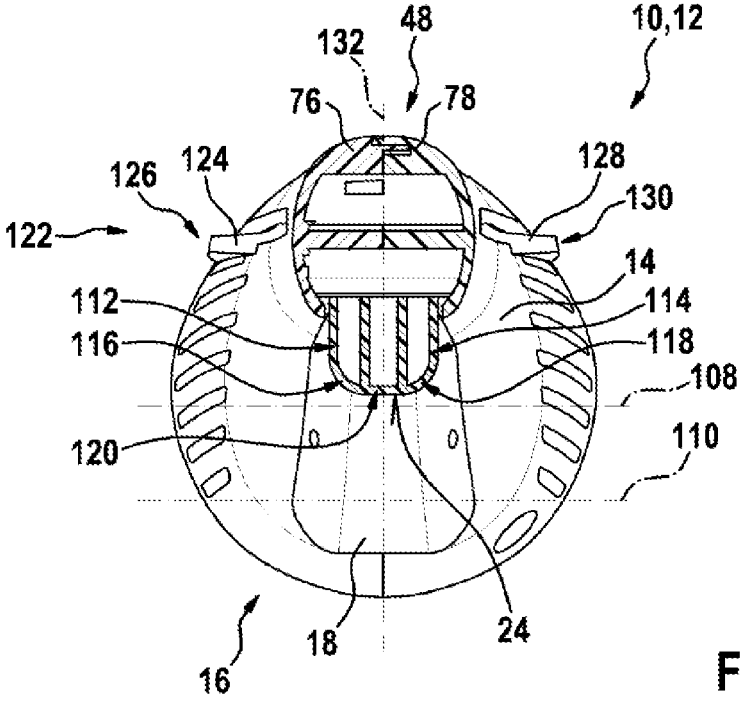
FIG. 5 shows a further detail view of the latch element arranged on the handle housing, in a schematic representation.

In addition, the latch element 18 has at least one side wall region 112, which is connected, via a bow-shaped sub-region 116 of the latch element 18, to a grip surface region 120 of the latch element 18 that runs at least substantially perpendicularly in relation to the side wall region 112, wherein a ratio of a radius of the bow-shaped sub-region 116 to the maximum transverse extent 52 of the stem-type grip region 48 of the handle housing 14 is at least greater than 1 to 8 (FIG. 5). In total, the latch element 18 has two side wall regions 112, 114, each of which is respectively connected, via one of two bow-shaped sub-regions 116, 118 of the latch element 18, to the grip surface region 120 of the latch element 18 that runs at least substantially perpendicularly in relation to the side wall regions 112, 114. The grip surface region 120 of the latch element 18, as viewed along the direction of main extent 58 of the handle housing 14, extends at least over a major part of the maximum longitudinal extent 44 of the latch element 18. Moreover, the grip surface region 120 of the latch element 18, as viewed along the direction of main extent 58 of the handle housing 14, has an at least substantially flat course. Thus, the course of the grip surface region 120 of the latch element 18 is at least to a large extent dissociated from step-type offsets. It is also conceivable, however, for the grip surface region 120 of the latch element 18 to have at least one finger recess region, which is provided to receive at least one finger of a hand of an operator when the latch element 18 is being operated, or held.

Furthermore, the portable power tool 10 has at least one switch-on inhibitor unit 122, which is provided to avoid, at least to a large extent, a movement of the latch element 18 as a result of an unintentional actuation of the latch element 18 (FIG. 1). The switch-on inhibitor unit 122 is realized as a mechanical inhibitor unit. It is also conceivable, however, for the switch-on inhibitor unit 122 to be realized as an electrical and/or electronic inhibitor unit. The switch-on inhibitor unit 122 has at least one release element 124, which comprises an actuating region 126 that is arranged, at least partially, laterally next to one of the side wall regions 112, 114 of the latch element 18 (FIG. 5). Moreover, the switch-on inhibitor unit 122 has at least one further release element 128, which has an actuating region 130 that is arranged, at least partially, laterally next to one of the side wall regions 112, 114 of the latch element 18 (FIG. 5). One of the side wall regions 112, 114 faces toward the release element 124, and one of the side wall regions 112, 114 faces toward the further release element 128. In this case, the actuating regions 126, 130 of the release element 124 and of the further release element 128 are arranged at a distance from the respective side wall region 112, 114, in each case as viewed, starting from the joint plane of the handle housing 14, in a direction running at least substantially perpendicularly in relation to the joint plane of the handle housing 14 and away from the handle housing 14. The release element 124 and the further release element 128 are arranged in a mirror-symmetrical manner in respect of the joint plane of the handle housing 14. In addition, the release element 124 and the further release element 128 are mounted so as to be pivotable about at least one release movement axis 132. The release movement axis 132 in this case runs in the joint plane of the handle housing 14. In addition, the release movement axis 132 runs at least substantially perpendicularly in relation to the pivot axes 108, 110 of the latch element 18.

In an alternative design of the portable power tool 10, which is not represented in greater detail here, it is conceivable for the portable power tool 10, in addition to having the switch-on inhibitor unit 122, to have an electrical and/or electronic start-up inhibitor, which, for example, only allows the drive unit 72 to be supplied with electric power once a sensor unit of the portable power tool 10 senses a further hand of an operator being in contact with the ancillary handle 74, in addition to a hand being in contact with the handle housing 14, in particular with the stem-type grip region 48, and thus deactivates the electrical and/or electronic start-up inhibitor, via an open-loop and/or closed-loop control unit of the portable power tool 10, which evaluates and processes the characteristic quantities sensed by means of the sensor unit, to enable the portable power tool 10 to be put into operation.

The invention claimed is:

1. A power tool, comprising:

at least one handle housing including (i) at least one switching unit that has at least one latch element arranged on the at least one handle housing, and (ii) at least one bearing unit, which is configured to mount the at least one latch element so as to be at least movable relative to the at least one handle housing, the at least one bearing unit including at least one lever mechanism unit configured to enable an at least substantially even travel movement over an entire operating surface of the at least one latch element, upon an actuation of the at least one latch element;

wherein the at least one lever mechanism unit includes a first lever bearing element and a second lever bearing element, each movably connected to the at least one latch element at an end of the at least one latch element that faces toward a connecting region of the at least one handle housing; and the second lever bearing element is arranged in a movable manner on a bearing element of the at least one bearing unit that is arranged on a side of an actuating region of a switching element of the at least one switching unit that faces toward the connecting region of the at least one handle housing.

2. The power tool as claimed in claim 1, wherein the at least one lever mechanism unit is configured as a parallelogram lever mechanism unit.

3. The power tool as claimed in claim 1, wherein the at least one lever mechanism unit includes at least one lever bearing element movably connected to the at least one latch element and movably connected to the at least one handle housing, the at least one lever bearing element configured to actuate a switching element of the at least one switching unit in dependence on a movement of the at least one latch element.

4. The power tool as claimed in claim 1, wherein the at least one latch element has a maximum longitudinal extent that corresponds to at least 60% of a maximum longitudinal extent of a stem-type grip region of the at least one handle housing.

5. The power tool as claimed in claim 4, wherein a ratio of the maximum longitudinal extent of the at least one latch element to the maximum longitudinal extent of the stem-type grip region of the at least one handle housing is at least greater than 1 to 1.4.

6. The power tool as claimed in claim 1, wherein the at least one latch element has a maximum transverse extent that corresponds to at least 60% of a maximum transverse extent of a stem-type grip region of the at least one handle housing.

7. The power tool as claimed in claim 6, wherein a ratio of the maximum transverse extent of the at least one latch element to the maximum transverse extent of the stem-type grip region of the at least one handle housing is at least greater than 1 to 2.5.

8. The power tool as claimed in claim 1, wherein the at least one switching unit further includes at least one switching element having an actuating region that is subjected to load by a spring element of the at least one switching unit and that, in at least one operating state, is configured to apply a force to the at least one latch element, in a direction of an initial position of the at least one latch element, as a result of a spring force of the spring element.

9. A power tool switching device of a power tool having at least one handle housing, comprising:

at least one switching unit including at least one latch element arranged on the at least one handle housing; and at least one bearing unit configured to mount the at least one latch element a movable manner relative to the at least one handle housing, the at least one bearing unit including at least one lever mechanism unit configured to enable an at least substantially even travel movement over an entire operating surface of the at least one latch element, upon an actuation of the at least one latch elements;

wherein the at least one lever mechanism unit includes a first lever bearing element and a second lever bearing element, each movably connected to the at least one latch element at an end of the at least one latch element that faces toward a connecting region of the at least one handle housing; and the second lever bearing element is arranged in a movable manner on a bearing element of the at least one bearing unit that is arranged on a side of an actuating region of a switching element of the at least one switching unit that faces toward the connecting region of the at least one handle housing.

10. A power tool, comprising:

at least one handle housing including (i) at least one switching unit that has at least one latch element arranged on the at least one handle housing, and (ii) at least one bearing unit, which is configured to mount the at least one latch element so as to be at least movable relative to the at least one handle housing, the at least one bearing unit including at least one lever mechanism unit configured to enable an at least substantially even travel movement over an entire operating surface of the at least one latch element, upon an actuation of the at least one latch element;

wherein the at least one lever mechanism unit includes at least one lever bearing element movably connected to the at least one latch element and the at least one handle housing at an end of the at least one latch element that faces toward a connecting region of the at least one handle housing; and the at least one lever bearing element is configured to actuate a switching element of the at least one switching unit in dependence on a movement of the at least one latch element.

* * * * *